US006027768A

United States Patent [19]

Koskinen et al.

[11] Patent Number: 6,027,768

[45] **Date of Patent: *Feb. 22, 2000**

[54] COATER NOZZLE HAVING MEANS FOR PREVENTING THE PLUGGING THEREOF, AND METHOD OF PREVENTING PLUGGING OF A COATER NOZZLE

[75] Inventors: Jukka Koskinen, Järvenpää; Vilho Nissinen, Numminen, both of Finland

[73] Assignee: Valmet Corporation, Helsinki, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/807,480

[22] Filed: Feb. 27, 1997

[30] Foreign Application Priority Data

Feb. 28, 1996 [FI] Finland ..... 960924

[51] Int. Cl.[7] ..... B05B 13/02

[52] U.S. Cl. ..... 427/424; 118/302; 118/410; 118/419

[58] Field of Search ..... 210/459; 427/421, 427/424, 427; 425/197, 199; 118/410, 419, 302, 600, 325, 610

[56] References Cited

U.S. PATENT DOCUMENTS

| | | | |
|---|---|---|---|
| 3,431,597 | 3/1969 | Nowak et al. | 425/197 |
| 3,903,843 | 9/1975 | Jones | 118/412 |
| 4,489,671 | 12/1984 | Choinski | 118/412 |
| 5,226,963 | 7/1993 | Shibata et al. | 118/410 |

FOREIGN PATENT DOCUMENTS

| | | |
|---|---|---|
| 0 358 434 | 3/1990 | European Pat. Off. . |
| 90267 | 4/1993 | Finland . |
| 90575 | 7/1993 | Finland . |
| 92231 | 8/1993 | Finland . |
| 953126 | 6/1995 | Finland . |
| 2723863 | 8/1995 | France . |
| 24 51 740 | 5/1976 | Germany . |

*Primary Examiner*—Brenda A. Lamb

*Attorney, Agent, or Firm*—Cohen, Pontani, Lieberman & Pavane

[57] ABSTRACT

An apparatus and method for preventing plugging of a narrow, slot-orifice-type jet nozzle 6 used in a paper and board coater in which the jet nozzle extends over the entire cross-machine width of the web being coated. The coater has an application chamber 11, a coating mix infeed channel 5 connected thereto and a clot orifice 6 as well as at least one inlet port 13 for feeding the coating mix into the application chamber 11. An easily cleanable strainer element 12 is placed close to the applicator apparatus to separate aggregates of the coating mix that otherwise could plug the slot orifice 6.

16 Claims, 1 Drawing Sheet

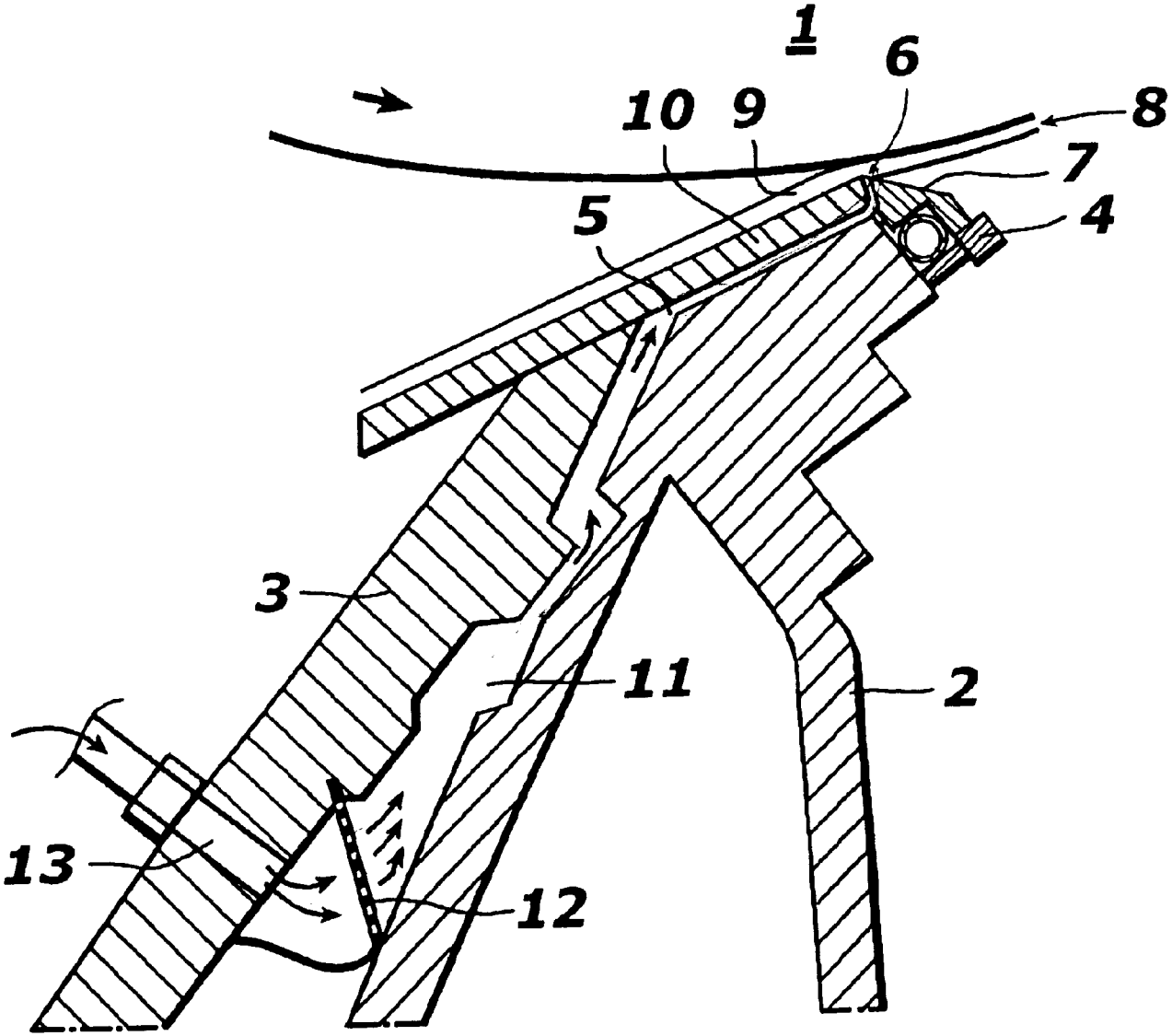
8
7
4
6
1
9
10
5
2
11
12
3
13

COATER NOZZLE HAVING MEANS FOR PREVENTING THE PLUGGING THEREOF, AND METHOD OF PREVENTING PLUGGING OF A COATER NOZZLE

FIELD OF THE INVENTION

An apparatus for preventing the plugging of the narrow, slot-orifice-type nozzle used for coating paper and board in which the nozzle extends over the entire cross-machine width of the web being coated.

BACKGROUND OF THE INVENTION

A coater type conventionally used in paper-making is an applicator apparatus called a jet applicator. This apparatus is a variant of nozzle applicators, wherein the coating mix is applied in a noncontacting manner to the web surface via a very narrow slot orifice. One of the advantages of jet-application techniques is the small pumping rate (3–4 liters of coating mix per second and linear meter of slot orifice) and the small amount of excess coat return flow. The method is particularly suited for web speeds slower than 1000 m/min, because at high web speeds the air film travelling on the web surface begins to disturb the stability of the impinging jet. As the apparatus is rather sensitive to air entrained in the coating mix, an air separator is required in the coating mix circulation, because otherwise the air bubbles of the applied coating mix could cause uncoated spots. The narrow and low-impact discharge from the slot orifice of the jet applicator apparatus does not stress the web being coated and achieves some degree of coat penetration into the web being coated.

However, jet applicators are hampered by being highly sensitive to plugging of the slot orifice, which can be traced to the narrow opening of the orifice. Hence, even very small impurities or hardened coating paste aggregates can get trapped in the slot orifice causing coat defects and requiring cleaning of the orifice. Obviously, a production shut-down is necessary for opening and carefully cleaning the nozzle chamber. To avoid coating mix aggregates from reaching the applicator apparatus and therefrom the web, the coating mix circulation is in most coater installations equipped with strainers designed to remove aggregates and lumps from the circulating coating mix. The strainers are placed between the coating mix tank and the coater unit in the coat circulation. While the screening capacity in the circulation and the separation efficiency of strainers conventionally used in the circulation are sufficient for a majority of coating methods, these screening techniques may pass coating mix aggregates which in jet applicator apparatuses can plug the slot orifice. A source of such aggregates is the coating mix infeed piping section between the strainer and the coater unit. Some amount of the circulating coat easily adheres to this part of the piping or hardens therein so as to become later dislodged as lumps or strips which travel in the coating mix circulation and plug the slot orifice of the jet applicator if allowed to reach that far. Such hardening of the coating mix is chiefly due to small inflow rate to the jet assembly, whereby also the volume change rate and flow velocity of the coat in the piping remain small. While other types of coaters not using the jet-application technique are relatively insensitive to small amounts of coating mix aggregates, the jet applicator has been found to require an almost zero content of aggregates in the coating mix because of the narrow nozzle slot.

SUMMARY OF THE INVENTION

It is an object of the present invention to provide an apparatus capable of preventing the access of aggregates into the slot orifice of a jet applicator apparatus.

The goal of the present invention is achieved by adapting an easily cleanable strainer close to the applicator apparatus that serves to screen away aggregates from the coating mix prior to their access into the slot orifice.

According to a preferred embodiment of the invention, the trainer is adapted into the coating mix application chamber of the applicator apparatus.

The method according to the present invention comprises straining coating mix supplied to a coater nozzle before the coating mix reaches the slot orifice of the nozzle.

The invention offers significant benefits.

By virtue of the invention, it is possible to eliminate the plugging problem of the application nozzle even when the slot orifice opening is very narrow-gapped, whereby unnecessary shutdowns for opening the coater assembly are avoided. Thus, the uninterrupted run periods of the coater station can be extended, which contributes substantially to improved profitability of the coater. The embodiment according to the invention does not essentially alter the pressure head of the coating mix circulation nor require changes in the equipment construction.

Other objects and features of the present invention will become apparent from the following detailed description considered in conjunction with the accompanying drawing. It is to be understood, however, that the drawing is intended solely for purposes of illustration and not as a definition of the limits of the invention, for which reference should be made to the appended claims.

BRIEF DESCRIPTION OF THE DRAWING

The FIGURE is a cross-sectional drawing of a preferred embodiment of the present invention.

DETAILED DESCRIPTION OF THE PRESENTLY PREFERRED EMBODIMENT

Referring to the FIGURE, the main parts of a jet applicator apparatus are a main beam 2 with a wall 3 which is attached thereto so as to form an application chamber 11 in cooperation with the main beam 2. To the main beam 2 is attached the upper lip 7 of a slot orifice 6 so that the upper lip 7 can be moved with the help of an actuator 4 in order to adjust the opening of the slot orifice 6. The lower lip 10 of the slot orifice 6 is attached to the wall 3, whereby its function is act as a border or side of the slot orifice 6, and a meandering coating mix infeed channel 5 passing from the application chamber 11 to the slot orifice 6. The coating mix is fed into the application chamber 11 via an inlet port 13. During coater operation, a required amount of coating mix is fed into the application chamber 11, wherefrom the coat passes via the coating mix infeed channel 5 and the slot orifice 6 to the surface of the web supported by a backing roll 1. A portion of the coating mix jet adheres to the web surface forming a coat layer 8, while the excess coat forms a return flow 9 travelling in a direction reverse to the web travel direction.

According to the present invention, into the application chamber 11 is mounted a strainer 12 suitable for separating aggregates from the coating mix flow before they can plug the slot orifice 6. The strainer 12 can be implemented as a slotted, perforated-hole or mesh strainer, and when adapted into the application chamber 11, its width will be substantial, whereby the active area of the strainer 12 passed by the coating mix flow becomes very large and the pressure loss over the strainer drops to an insignificant value. Thus, the separation efficiency of the strainer can be substantially high provided that the openings of the strainer are made smaller than the minimum opening of the slot orifice. Alternatively, the strainer can be mounted, e.g., to the coating mix inlet port 13, or immediately in front thereof, so that the coating mix can pass directly from the strainer 12 into the inlet port 13. However, a strainer placed into the application chamber 11, as close to the slot orifice 6 as possible, offers a higher performance in the separation of particulate matter, because in this location the strainer can also separate coating mix lumps possibly formed within the application chamber. The strainer should in any case be placed sufficiently close to the applicator apparatus so that no section of the coating mix infeed piping remains between the strainer and the applicator apparatus, which means that the strainer must be located on the coating mix path in the section remaining between the inlet port, to which the coating mix circulation piping is terminated, and the slot orifice. According to this design rule, the coating mix infeed piping can be directly connected the strainer, wherefrom the coating mix can immediately reach the infeed port of applicator apparatus.

Thus, while there have been shown and described and pointed out fundamental novel features of the invention as applied to a preferred embodiment thereof, it will be understood that various omissions and substitutions and changes in the form and details of the device illustrated, and in its operation, may be made by those skilled in the art without departing from the spirit of the invention. For example, it is expressly intended that all combinations of those elements which perform substantially the same function in substantially the same way to achieve the same results are within the scope of the invention. Substitutions of elements from one described embodiment to another are also fully intended and contemplated. It is also to be understood that the drawing is not necessarily drawn to scale but that it is merely conceptual in nature. It is the intention, therefore, to be limited only as indicated by the scope of the claims appended hereto.

We claim:

1. A jet nozzle apparatus for applying a coating mix to a paper or board web comprising:

an application chamber for containing the coating mix which is in fluid communication with a slot orifice which is spaced from the web, the slot orifice for jet-application of the coating mix onto a paper or board web, the application chamber being connected to the slot orifice by a meandering coating mix infeed channel, the application chamber having an inlet port for feeding coating mix into the application chamber from a supply of coating mix; and a strainer element mounted within the application chamber in a flow path of the coating mix from the inlet port to the slot orifice such that the coating mix fed through the inlet port flows first into a lower portion of the application chamber then through the strainer element and into an upper portion of the application chamber, the strainer element being positioned across a cross-section of the application chamber at an angle relative to the flow path of the coating mix through the strainer element, the strainer element being one of a slotted-orifice, a perforated-hole strainer, and a mesh strainer.

2. The nozzle apparatus of claim 1, wherein the strainer element is substantially planar.

3. The nozzle apparatus of claim 1, wherein the strainer element is a slotted-orifice.

4. The nozzle apparatus of claim 3, wherein the strainer element has an opening therein smaller than the slot orifice.

5. The nozzle apparatus of claim 1, wherein the strainer element is a perforated-hole strainer.

6. The nozzle apparatus of claim 5, wherein the strainer element has openings therein smaller than the slot orifice.

7. The nozzle apparatus of claim 1, wherein the strainer element is a mesh strainer.

8. The nozzle apparatus of claim 7, wherein the strainer element has openings therein smaller than the slot orifice.

9. A method of preventing clogging of a slot orifice in a jet nozzle application apparatus for jet-application of a coating mix to a paper or board web, the nozzle apparatus comprising an application chamber for containing the coating mix which is in fluid communication with a slot orifice which is spaced from the web, the slot orifice provides for jet-application of the coating mix onto through which coating mix is applied to the web, the application chamber being connected to the slot orifice by a meandering coating mix infeed channel, and the application chamber having an inlet port for feeding the coating mix into the application chamber from a supply of coating mix, said method comprising:

straining the coating mix fed through the nozzle apparatus using a strainer element which is mounted in the application chamber such that a flow path of the coating mix fed through the inlet port flows first into a lower portion of the application chamber then through the strainer element and into an upper portion of the application chamber, the strainer element being mounted at an angle relative to the flow path of the coating mix through the strainer element and being one of a slotted-orifice, a perforated-hole strainer, and a mesh strainer.

10. The method of claim 9, wherein the strainer element is substantially planar.

11. The method of claim 9, wherein the strainer element is a slotted-orifice.

12. The method of claim 11, wherein the strainer element has an opening therein smaller than the slot orifice.

13. The method of claim 9, wherein the strainer element is a perforated-hole strainer.

14. The method of claim 13, wherein the strainer element has openings therein smaller than the slot orifice.

15. The method of claim 9, wherein the strainer element is a mesh strainer.

16. The method of claim 15, wherein the strainer element has openings therein smaller than the slot orifice.

* * * * *